US006533709B1

(12) United States Patent
Jones

(10) Patent No.: US 6,533,709 B1
(45) **Date of Patent: *Mar. 18, 2003**

(54) STANDING PUSH/PULL EXERCISE MACHINE AND METHOD OF USING THE SAME

(75) Inventor: Gary Allen Jones, Daytona Beach, FL (US)

(73) Assignee: Brunswick Corp., IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/452,673

(22) Filed: Dec. 1, 1999

Related U.S. Application Data

(63) Continuation of application No. 08/933,051, filed on Sep. 18, 1997, now Pat. No. 6,010,437.

(51) Int. Cl.[7] ..... A63B 21/08
(52) U.S. Cl. ..... 482/97; 402/137; 402/138
(58) Field of Search ..... 482/94, 97, 100; 402/136–138

(56) References Cited

U.S. PATENT DOCUMENTS

| | | | | | |
|---|---|---|---|---|---|
| 956,264 | A | * | 4/1910 | Bailey | 482/72 |
| 5,044,631 | A | | 9/1991 | Jones | |
| 5,044,632 | A | | 9/1991 | Jones | |
| 5,050,873 | A | | 9/1991 | Jones | |
| 5,066,003 | A | | 11/1991 | Jones | |
| 5,066,004 | A | | 11/1991 | Jones | |
| 5,106,080 | A | | 4/1992 | Jones | |
| 5,125,881 | A | | 6/1992 | Jones | |
| 5,135,449 | A | * | 8/1992 | Jones | 482/72 |
| 5,135,456 | A | | 8/1992 | Jones | |
| 5,171,198 | A | | 12/1992 | Jones | |
| 5,180,354 | A | | 1/1993 | Jones | |
| 5,181,896 | A | | 1/1993 | Jones | |
| 5,273,504 | A | | 12/1993 | Jones | |
| 5,273,505 | A | | 12/1993 | Jones | |
| 5,554,089 | A | | 9/1996 | Jones | |
| 5,554,090 | A | | 9/1996 | Jones | |
| RE35,470 | E | | 3/1997 | Jones | |
| 6,010,437 | A | * | 1/2000 | Jones | 482/97 |

* cited by examiner

*Primary Examiner*—Stephen R. Crow
*Assistant Examiner*—Tam Nguyen
(74) *Attorney, Agent, or Firm*—Mayer, Brown, Rowe & Maw

(57) ABSTRACT

A standing push/pull exercise machine includes a frame with first and second frame sections located on opposite sides of a midplane, and defining a standing exercise position therebetween. Each frame section includes a pivotal lever which is pivotal against a selected weight resistance, preferably along a movement path which converges toward the midplane with respect to the forward facing direction of an exerciser. One of the frame sections and its corresponding levers is located further rearward of the other frame section and lever, and it is adapted for movement against a weight resistance via a pushing motion, while the other lever is adapted for movement against a weight resistance via a pulling motion. Thus, this exercise machine enables an exerciser to simultaneously perform, from a standing position, a pushing and a pulling exercise motion along prescribed converging paths of motion, thereby to achieve optimal "positive" and reverse exercise for the same muscle groups located on opposite sides of the body. A mirror image of the exercise machine may be used to work the muscle groups in the other direction, i.e., in a pull/push motion to get the full benefit of positive/reverse exercise motion along the prescribed paths. Also, simultaneous performance of the push/pull (or the pull/push) exercise motion provides muscular benefits for the midsection, due to a twisting effect generated at the torso.

19 Claims, 5 Drawing Sheets

STANDING PUSH/PULL EXERCISE MACHINE AND METHOD OF USING THE SAME

This is a continuation of application Ser. No. 08/933,051, filed Sep. 18, 1997, now U.S. Pat. No. 6,010,437.

FIELD OF THE INVENTION

This invention relates to weight training exercise machines, and more particularly a weight training exercise machine wherein the exerciser performs an exercise maneuver from a standing position.

BACKGROUND OF THE INVENTION

Applicant has invented and developed a number of weight training exercise machines designed to more naturally accommodate the musculoskeletal structure of the human body with respect to the performance of particular muscular movement. These inventions are shown and described in the following U.S. patent applications: patent application Ser. No. 08/594,526 entitled "Body Extension Exercise Machine" filed Jan. 31, 1996, currently pending; U.S. Pat. No. 5,044,631 entitled "Decline Press Exercise Machine" issued Sep. 3, 1991; U.S. Pat. No. 5,044,632 entitled "Dumbbell Press Exercise Machine" issued Sep. 3, 1991; U.S. Pat. No. 5,050,873 entitled "Pulldown Exercise Machine" issued Sep. 24, 1991; U.S. Pat. No. 5,066,003 entitled "Leg Curl Exercise Machine" issued Nov. 19, 1991; U.S. Pat. No. 5,066,004 entitled "Leg Extension Exercise Machine" issued Nov. 19, 1991; U.S. Pat. No. 5,106,080 entitled "Leg Press Exercise Machine" issued Oct. 21, 1995; U.S. Pat. No. 5,125,881 entitled "Rear Deltoid Exercise Machine" issued Jun. 30, 1992; U.S. Pat. No. 5,135,449 entitled "Rowing Exercise Machine" issued Aug. 4, 1992; U.S. Pat. No. 5,135,456 entitled "Low Row Exercise Machine" issued Aug. 4, 1992; U.S. Pat. No. 5,171,198 entitled "Lateral Raise Exercise Machine" issued Dec. 15, 1992; U.S. Pat. No. 5,180,354 entitled "Rotary Cuff Exercise Machine" issued Jan. 19, 1993; U.S. Pat. No. 5,181,896 entitled "Incline Press Exercise Machine" issued Jan. 26, 1993; U.S. Pat. No. 5,273,504 entitled "Behind the Neck Pulldown Exercise Machine" issued Dec. 28, 1993; U.S. Pat. No. 5,273,505 entitled "High Row Exercise Machine" issued Dec. 28, 1993; U.S. Pat. No. 5,554,084 entitled "Abdominal/Hip Flex Exercise Machine" issued Sep. 10, 1996; U.S. Pat. No. 5,554,089 entitled "Military Press Exercise Machine" issued Sep. 10, 1996; U.S. Pat. No. 5,554,090 entitled "Calf Exercise Machine" issued Sep. 10, 1996; and U.S. Pat. No. RE35,470 (reissuance of U.S. Pat. No. 5,181,896) entitled "Incline Press Exercise Machine" issued Mar. 4, 1997.

Generally, the exercise machines shown and described in these patents include one or more rotatable levers which are engaged by an exerciser, usually by the hand or leg, to move the lever through an exercise plane which is oriented at a specific angle or position with respect to the torso of the body. The movement path of the lever is designed to minimize stress and discomfort on the musculoskeletal joints, while maximizing the muscular benefit achieved via performance of the exercise motion.

One of the above-identified U.S. patent applications, specifically U.S. Pat. No. RE35,470 (reissuance of U.S. Pat. No. 5,181,896) entitled "Incline Press Exercise Machine," relates to an exercise machine which enables an exerciser to perform a chest press exercise motion from a standing position or a seated position. When the exercise machine covered by this patent does not include the seat, and the exercise is performed from a standing position, the exerciser achieves additional muscular benefit in the stomach and upper leg muscles due to the need to stand and brace the weight of the body against the pushing motion. The standing version of the exercise machine covered by this patent has become particularly popular with football players who play on the offensive line, because the standing press motion mimics the motion used during pass blocking. While the same upper body muscles could be worked via performance of the same motion from a seated position, a more natural feel is achieved and abdominal and rear end muscles are more naturally worked via performance of this exercise from a standing position.

It is an object of this invention to further expand upon the principle of performing a prescribed exercise motion from a standing position.

Traditionally, a number of health clubs have used wall mounted weighted pulleys to enable an exerciser to move a weight stack upwardly by moving a handle from the wall, with the exerciser being in a standing position during the movement. Depending upon the orientation of the exerciser with respect to the wall, the handle can either be pulled away from the wall toward the body, or pushed away from the body and the wall. In the former case, the exerciser would typically be standing in a position where he or she is facing the wall, while in the latter example, the exerciser would typically be standing in a position wherein he or she is facing outwardly from the wall. With either motion, the exerciser achieves some muscular benefit in the abdominal and rear end muscles because the exercise pulling or pushing motion is performed from a standing position. Nevertheless, although this device enables an exerciser to perform either a pushing or a pulling motion, it is not capable of being used for the performance of simultaneous pushing and pulling with opposite hands.

Thus, the versatility of this device relates primarily to the ability of the exerciser to move the handle to any desired position and free space. But that versatility can also cause some problems because inexperienced exercisers or perhaps those rehabilitating an injury may have difficulty in confining and controlling the exercise movement within a desired path, because the handle will always be subject to a force section directly straight toward the pulley at the top of the weight stack.

It is another object of this invention to improve upon the degree of control an exerciser has over the motion path of an exercise device used in a pushing or pulling motion, particularly when performed in a standing mode.

For various athletes involved in weight training via the use of exercise machines or devices of various types, it is common for the exerciser to use the machine or device to exercise a muscle group against a weight resistance via movement of an arm or leg in a first prescribed direction, and then to subsequently use reverse or opposite movement, via "negative resistance," to work the same muscle group in an opposite direction. Typically, the performance of "negatives" is done with the assistance of one or more other exercisers, or "spotters" who may actually apply manual resistance to the machine or device to prevent its movement back to its normal at rest position.

Although the muscular benefits achieved via the performance of "negatives" can play an important role in the muscular development of an athlete, the manual application of resistance to an exercise machine or device by one or more spotters can create a dangerous situation, or it can increase wear and tear on the exercise machine or device. Even if negative resistance is applied by an experienced spotter, maximum muscular benefit may not be achieved due to inconsistency in the application of the negative resistance. In other words, most exercise machines or devices are simply not adapted for performance of "negatives."

Although some specific rehabilitation equipment improves upon the degree of control of the application of "negative resistance," such machines are usually quite bulky and fairly expensive due to this inclusion of various electronic controls such as timers, resistance measuring devices, etc. Thus, while such machines are helpful for an athlete performing a specific exercise for a specific muscle group during rehabilitation, such devices are not versatile enough or simply too expensive to be purchased for everyday use in a weight training or exercise facility.

It is still another objective of the invention to improve safety concerns related to the performance of a reverse exercise movement, and to do so in a manner which is sufficiently cost effective to enable everyday use and affordability for conventional exercise facilities or gyms.

SUMMARY OF THE INVENTION

The present invention achieves the above-stated objectives via a push/pull exercise machine which permits simultaneous positive/reverse exercise motion for opposite sides of the body, from a standing position, so that an exerciser may exercise the same muscle groups on opposite sides of the body via positive and reverse motions along prescribed exercise motion paths.

Because the push/pull exercise machine of this invention is particularly suitable for use by an exerciser in the standing position, or a standing mode, in addition to upper body exercise the exerciser also achieves muscular benefit for the abdominal muscles and muscles of the rear end. Additionally, by performing the pushing and the pulling exercise motions from a standing position, the exerciser is able to improve his or her balance.

Moreover, simultaneous performance of the pushing and the pulling motions creates a twisting effect on the torso of the exerciser, particularly when in the standing mode, thereby to further achieve muscular benefit for the abdominal and mid-section muscles of the exerciser. Preferably, the planes of motion prescribed by the exercise machine of this invention converge with respect to the forward facing direction of the exerciser, so that both the pushing and the pulling motions are performed along paths which more naturally accommodate the musculoskeletal structure of the human body.

Because of the particular physical arrangement of the exercise machine of this invention, which includes a frame made of two frame sections located on opposite sides of a midplane, with one framed section located slightly rearward of the other section, the one framed section is particularly suitable for performing a pushing motion while the other framed section is particularly suitable for performing a pulling motion. In effect, the pushing motion is the reverse motion or opposite of the pulling motion, and vice versa. When the pulling motion and pushing motion are performed simultaneously, the exerciser achieves the dual benefits of positive and opposite movement of the muscles of the muscle groups located on opposite sides of the body.

Because each separate section of the machine is specifically adapted for performing either a pushing or a pulling motion, a separate mirror image "pull/push" machine is used to perform pulling and pushing with the opposite hands. Thus, when used together, the two mirror-image machines provide positive/opposite exercise motion for the muscle groups on both sides of the exerciser, for both the pulling and the pushing motions. In other words, the two machines together accommodate both positive and reverse, or opposite, motion along the same relative prescribed motion paths. Therefore, by using the two machines together, this invention minimizes the need for the use of spotters to manually apply physical resistance to an exercise machine in order for an exerciser to perform "negatives" in order to achieve "reverse" exercise. Moreover, the exercise machine of this invention enables opposite or reverse motion to be performed in a relatively cost effective manner, because the machine itself is designed to be relatively simple from a structural standpoint, so that it is as easy to understand and use as other exercise machines typically used in a weight training facility. Because the paths of motion are prescribed by the exercise machine, these opposite exercise motions may be performed in a manner which does not increase wear and tear on the exercise machine or introduce a risk factor typically associated with manual application of "negative" resistance to a pivotal lever.

According to a preferred embodiment of the invention, a standing push/pull exercise machine includes a frame with first and second frame sections located on opposite sides of a midplane, with the frame defining an exercise position between the first and second frame sections for an exerciser facing a forward direction along the midplane. The first frame section is located rearwardly of the second framed section, relative to the midplane and the forward facing direction of the exerciser. A first lever pivotally connects to the first frame section, and the first lever includes a first handle and a first weight holder for holding a first selectable weight resistance. Upon grasping the first handle, an exerciser located in the exercise position, preferably in a standing mode, moves the handle in a forward direction against the first selected weight resistance, and along an exercise motion path which converges toward the midplane with respect to the forward facing direction. Thus, when the exerciser has fully extended his or her arm so that the handle is in a forwardmost position, the handle is closer to the midplane than when the handle is in its rearwardmost position, in the at rest position. The movement path of the first handle corresponds to a vertical plane which converges toward the midplane with respect to the forward facing direction of the exercise machine.

Opposite the first lever, on the second side of the frame, the exercise machine includes a second lever pivotally connected to the second frame section. Similar to the first lever, the second lever includes a second weight holder for holding a second selected weight resistance and a second handle adapted to be grasped by an opposite hand of the exerciser located in the exercise position defined by the frame. However, for the second lever, the handle resides in a forwardmost position when at rest, and it is grasped by the exerciser and pulled rearwardly along an exercise movement path so that in a rearward most position it is further away from the midplane. The second movement path for the second lever also converges with respect to the forward facing direction of the exerciser situated in the exercise position.

The second exercise path is oriented similar to the first exercise path, for working the same group of muscles on the opposite side of the exerciser's body, but with the exercise of the first lever being a pushing motion and the exercise of the second lever on the opposite side of the body being the opposite of the pushing motion, i.e., a pulling motion. In considering this matter from the opposite perspective, the second lever is used for the performance of a pulling motion, while the first lever is used for the opposite of the pulling motion, i.e., a pushing motion. Thus, reference to the term "push and pull" as either positive or opposite (or reverse) exercise motion depends upon the point of reference of the exerciser.

With another identical exercise machine, but which is a mirror image of the exercise machine shown and described, the exerciser is able to perform pull and push exercise motion, respectively, rather than the push and pull exercise motions. Thus, by using the two mirror image machines together, the exerciser is able to achieve optimal exercise benefit for this particular muscle group via the performance of both positive and reverse exercise motions, regardless of which particular motion is initially referred to as the positive motion. Moreover, because the first and second levers pivot independently of each other, the exerciser may also perform one exercise motion at a time. By performing simultaneous pushing and pulling exercise via this exercise machine, the exerciser creates a twisting exercise motion for the torso. This twisting effect represents a new and further muscular advantage over prior exercise machines, even prior exercise machines adapted for the performance of an exercise motion from a standing position.

These and other features of the invention will be more readily understood in view of the following detailed description and the drawings.

DETAILED DESCRIPTION OF THE DRAWINGS

FIGS. 1–4 show a push/pull exercise machine 10 constructed in accordance with a first preferred embodiment of the invention. Generally, this exercise machine 10 includes a frame 12 constructed of steel components similar to applicant's prior patents, and as will be readily understood by those skilled in the art.

Figure 1:
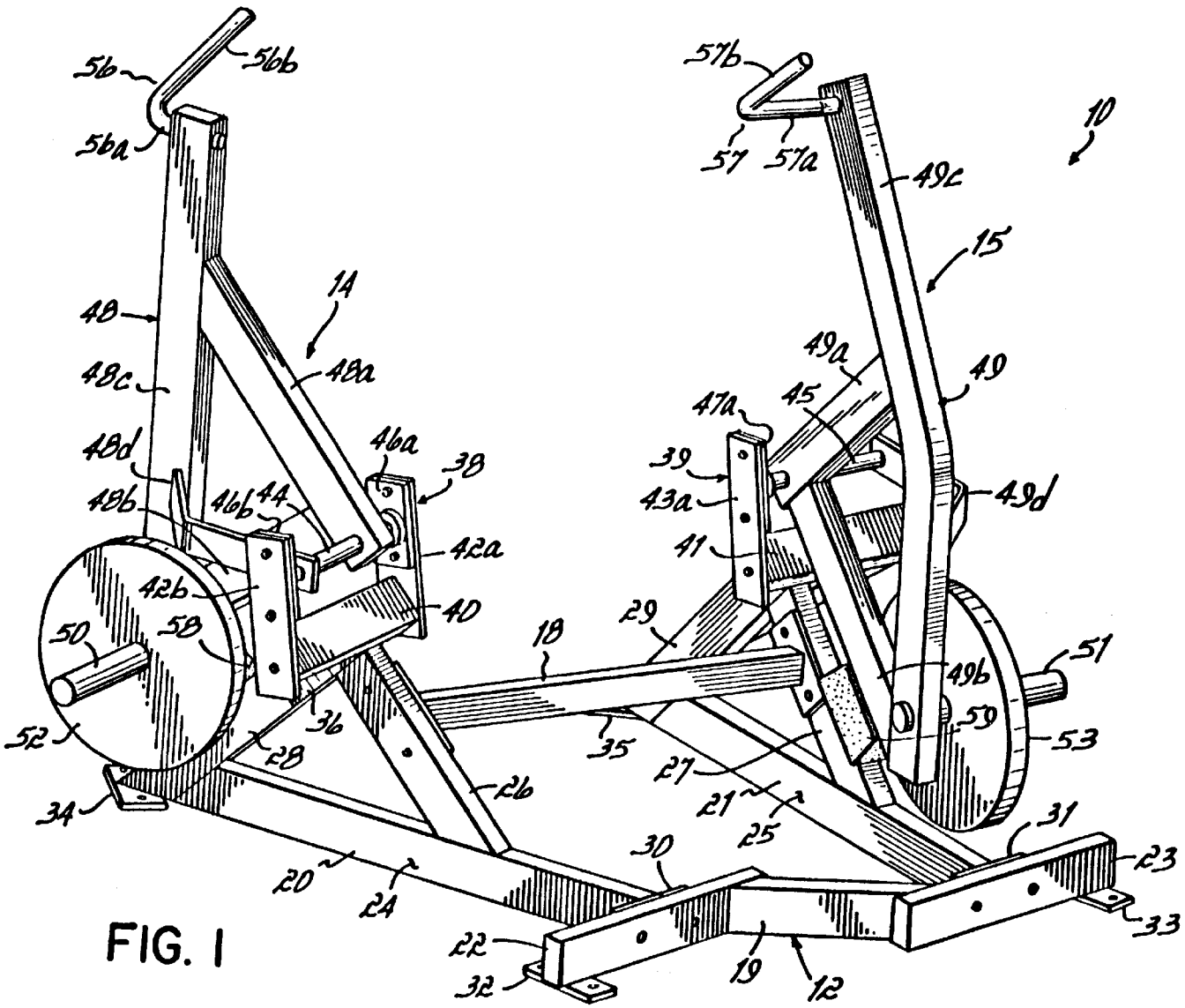
FIG. 1 is a perspective view of a push/pull exercise machine constructed in accordance with a preferred embodiment of the invention, as viewed from the front right side of the exercise machine and with the levers at rest.
Figure 2:
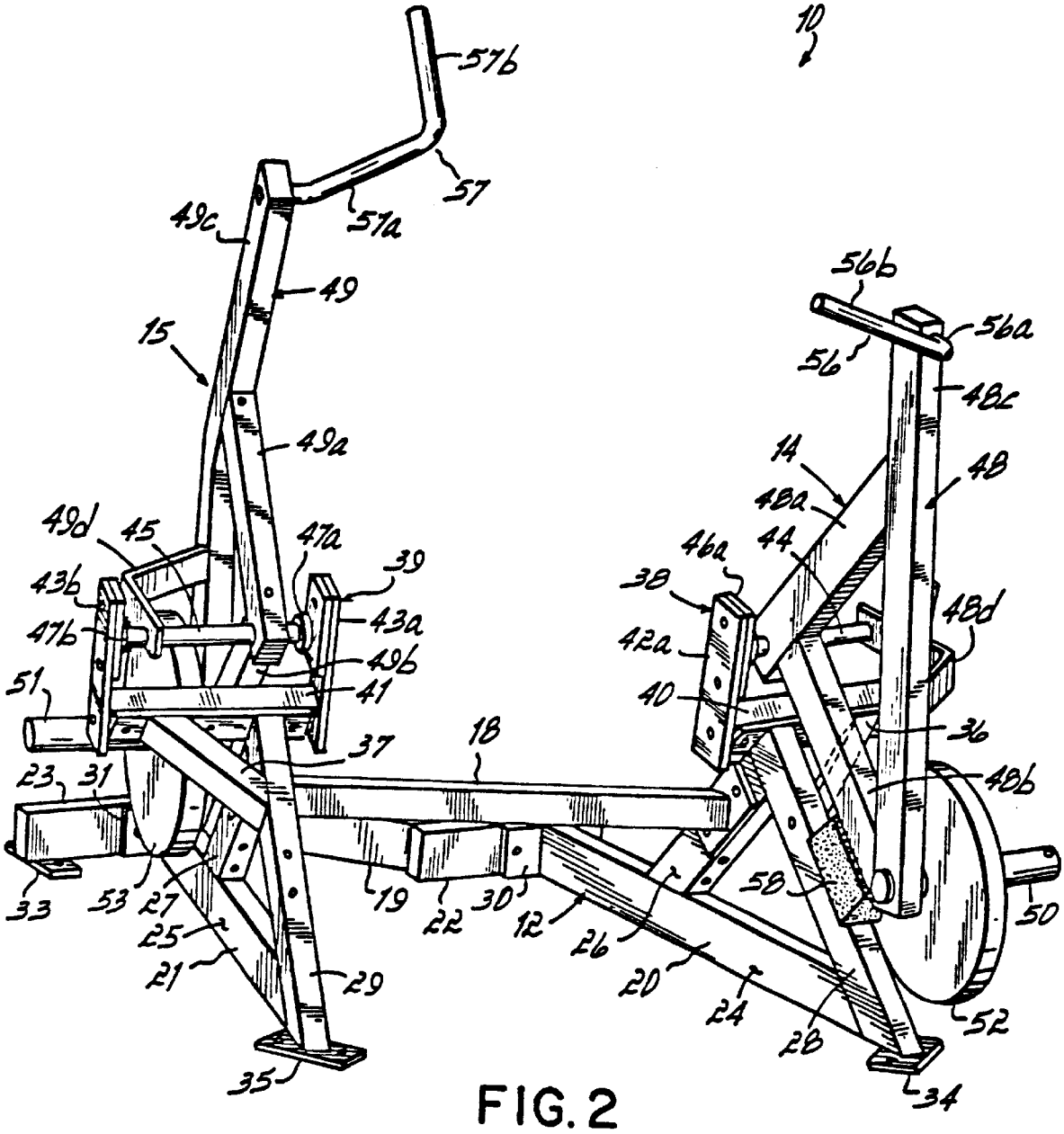
FIG. 2 is a perspective view of the push/pull exercise machine shown in FIG. 1.
Figure 3:
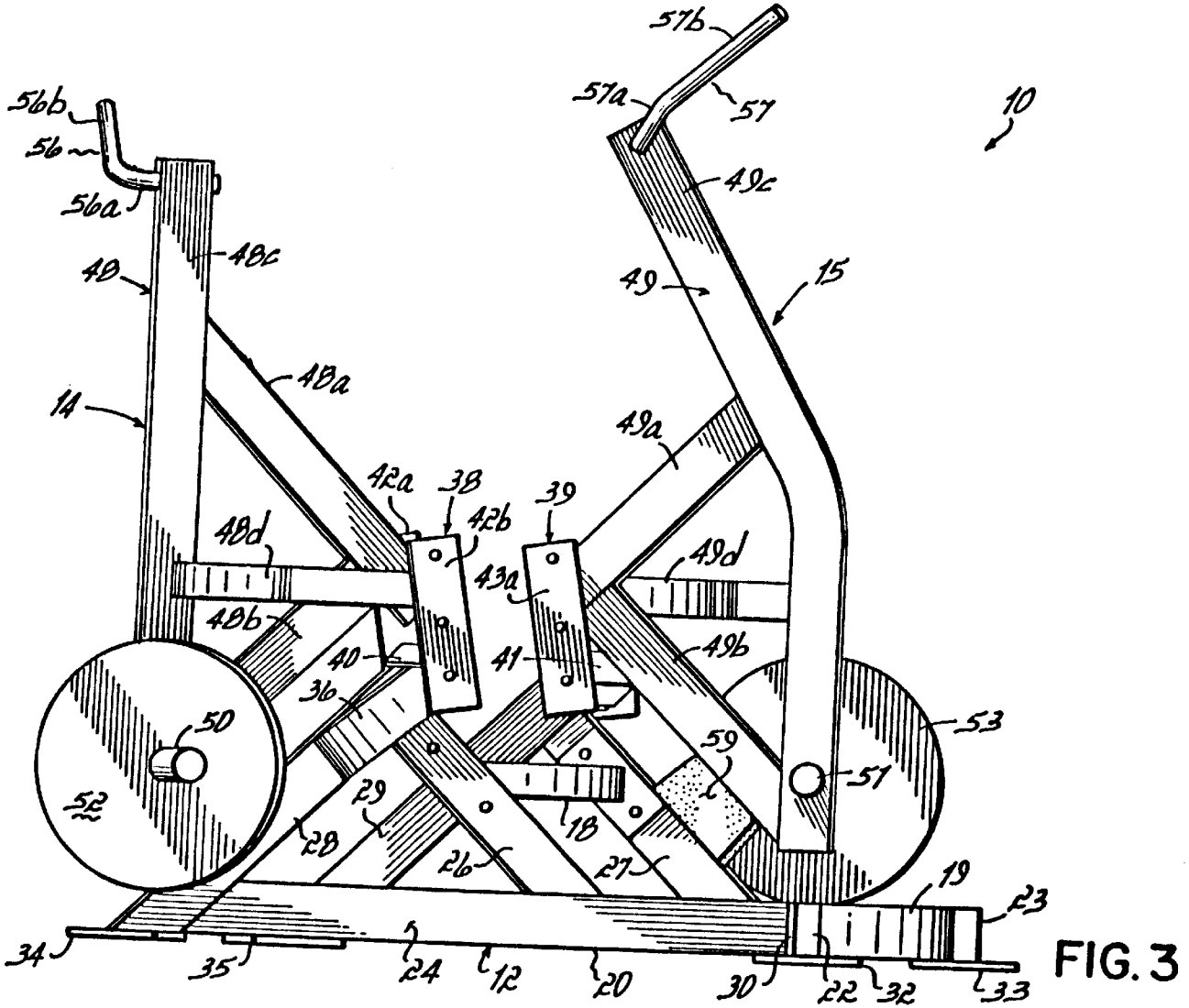
FIG. 3 is a side view, from the right side of the exercise machine shown in FIG. 1, as indicated by reference numbers 3—3 in FIG. 1.
Figure 4:
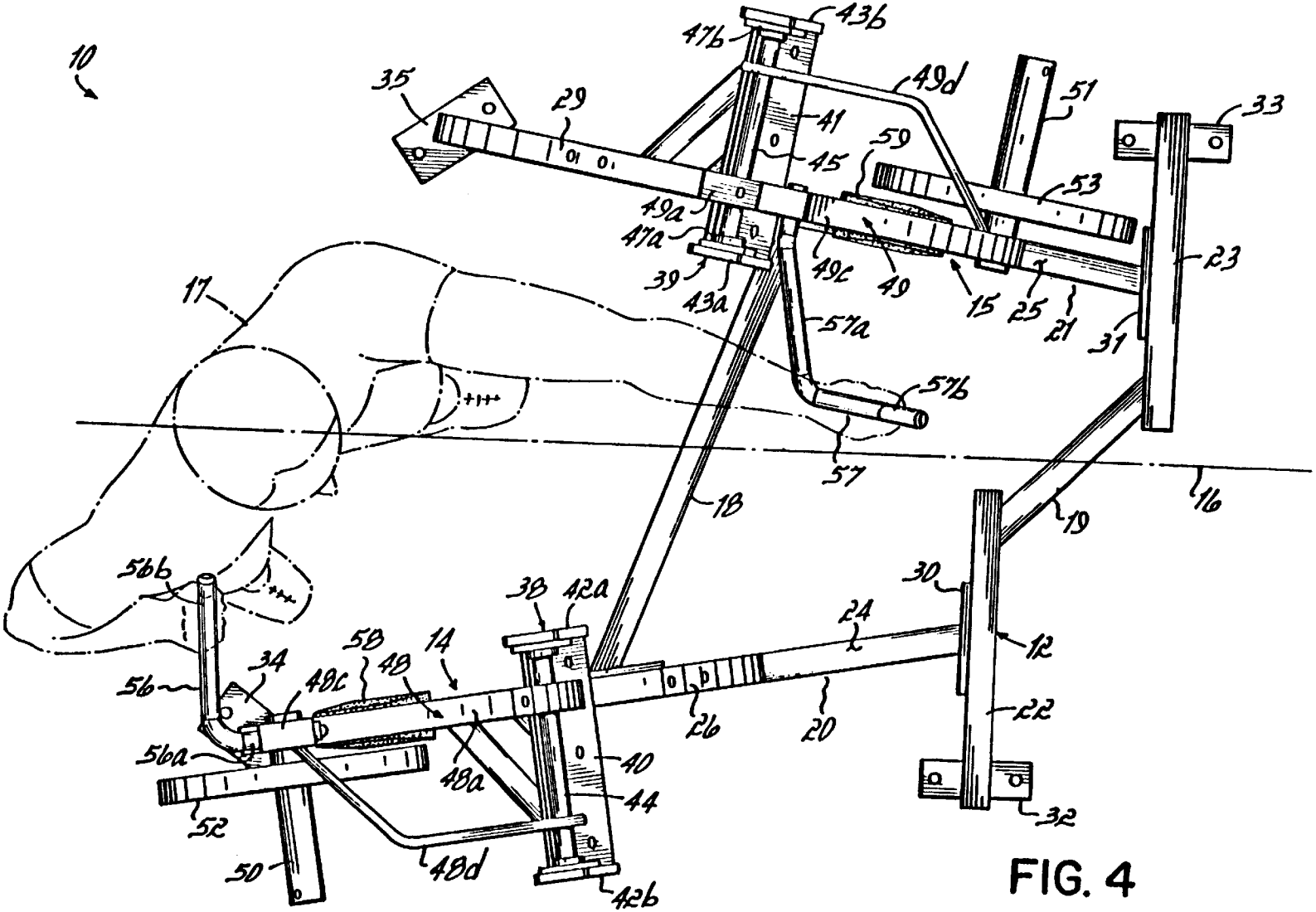
FIG. 4 is a plan view of the exercise machine shown in FIG. 1, but with an exerciser shown to illustrate the at rest positions of the levers.

Frame 12 includes a first frame section 14 and a second frame section 15 located on opposites sides of a vertical midplane 16 (the midplane 16 is best shown in FIG. 4). The first and second frame sections 14, 15 and the midplane 16 define, or surround, an exercise position 17, as best shown in FIG. 4. When in the exercise position 17, an exerciser is located along the midplane 16, and facing out of the page (as shown in FIG. 1) so that the first frame section 14 would be on the right side of the exerciser and the second frame section 15 would be on the left side of the exerciser.

Structurally, the frame 12 includes a rearward connector 18 and a forward connector 19 which interconnect the first frame section 14 and the second frame section 15. Generally, the first fame section 14 and the second frame section 15 are similar in construction, except the first frame section 14 is used for performing a pushing exercise motion while the second frame section 15 is adapted for providing a pulling exercise motion for an exerciser located in the exercise position, or location 17. Thus, the structures are almost identical, except that the movable levers of these frame sections are designed for opposite movement. This will be more readily understood in view of the following details.

The first frame section 14 includes a forward support 22 and a center support 24 connected at a right angle to the forward support 22. A first angled upright 26 and a back angled upright 28 extend upwardly from the center support 24, thereby defining an enclosed triangle. This construction generally defines the base 20 of the first frame section 14. The base 20 also includes a connecting plate 30 for interconnecting the center support 24 to the forward support 22, and a forward support plate 32 and a rearward support plate 34. A brace 36 extends upwardly at an angle from rear angled upright 28 (see FIG. 2).

Figure 5:
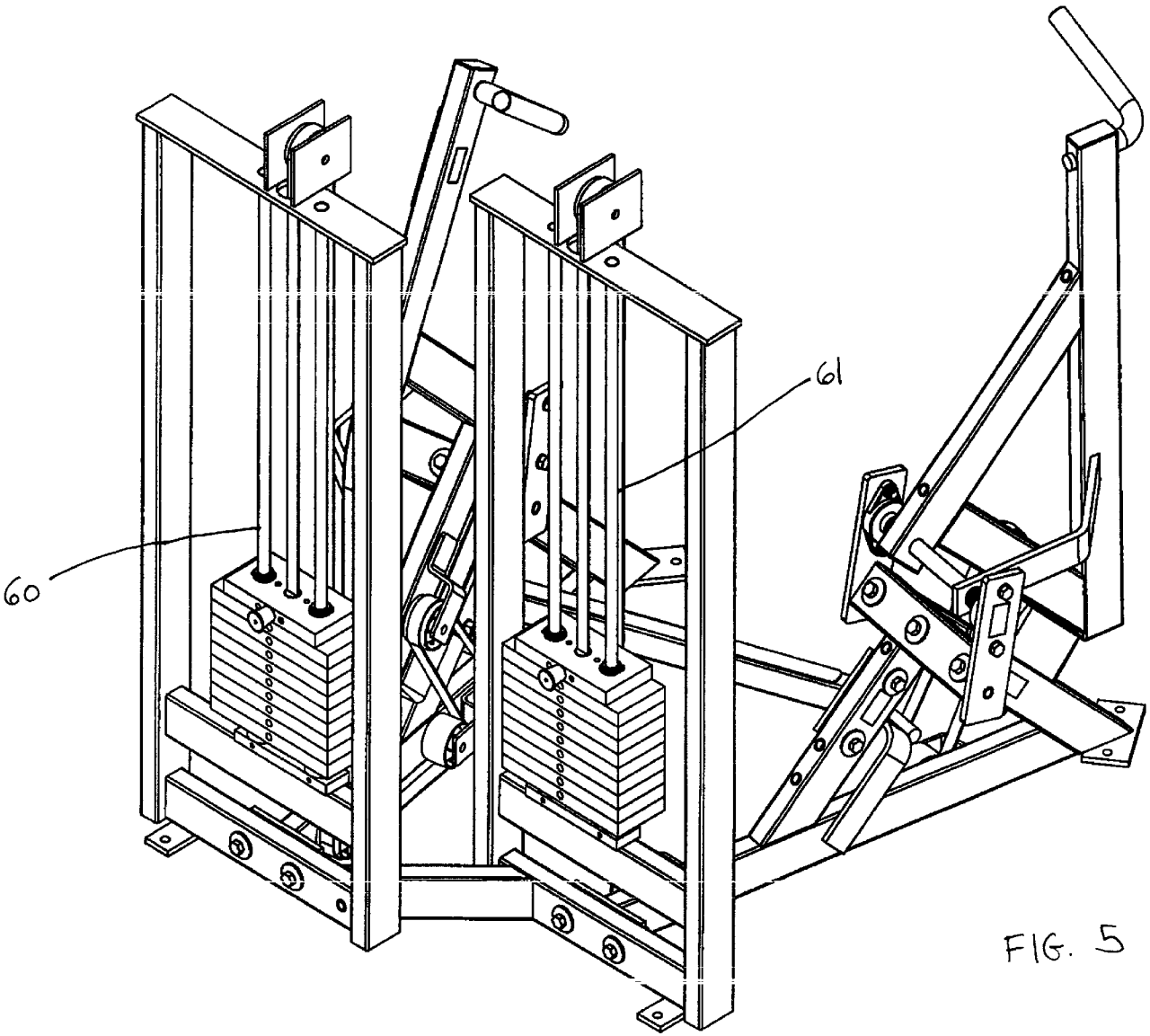
FIG. 5 is a perspective view of an alternative embodiment of a push/pull exercise machine, as viewed from the front left side of the exercise machine and with the levers at rest.

Above the base 20 of the first frame section 14, there is a structure generally referred to as a workbox 38. The workbox 38 includes a crossbar support 40 and internal and external uprights 42*a* and 42*b*, respectively. An axle 44 extends between the uprights 42*a* and 42*b* and is rotatable with respect thereto via its mounting to internal and external bearings 46*a* and 46*b*, respectively. A lever, designated generally by reference numeral 48, rigidly connects to axle 44. The lever 48 preferably includes upper and lower angled members 48*a* and 48*b*, respectively, and an elongated member 48*c* which defines a triangle with the upper and lower members 48*a* and 48*b*. The levers 48 and 49 also include angled braces 48*d* and 49*d*, respectively. A hub 50 connects to a bottom portion of the lever 48 at a location below the axle 44. The hub 50 extends outwardly from the midplane 16 and is adapted to hold one or more weighted plates 52 to provide a selectable weight resistance to movement of the lever 48. Alternatively, the hub 50 and weighted plate 52 may be removed so that the lever 48 is adapted for applying a selectable weight resistance via the use of a weighted stack held by a pulley or chain 60, 61 (see FIG. 5), as would be readily known by those skilled in the art of exercise machines.

At an upper end of the lever 48, particularly at the upper end of elongated member 48*c*, a handle 56 attaches thereto. Preferably, the handle 56 includes a first portion 56*a* which extends rearwardly and a second portion 56*b* which extends generally toward the midplane 16. The handle 56 is located a sufficient vertical distance above the floor so that an exerciser may readily grasp it with his or her right hand, preferably in a standing mode while located at the exercise position 17, so that the exerciser can rotate the lever 48 forward via a forwardly directed pushing motion. Because of the orientation of the first frame section 14 with respect to the midplane 16, this pushing motion causes the handle 56 to move closer to the midplane 16 as it is moved in the forward direction by the exerciser. Thus, the handle 56 converges toward the midplane 16 during the pushing motion, and according to the preferred embodiment shown in the figures, the handle 56 moves along a vertical plane which converges toward the midplane 16.

The first frame section 14 and the base 20 are also aligned along this converging plane, while the axle 44 is aligned at an orientation which is perpendicular to the plane of convergence. Thus, the axle 44 is aligned at an angle which is obtuse with respect to the midplane 16. As readily shown in the Figures, the first frame section 14 is located slightly rearwardly of the second frame section 15, thereby to make it better suited for performing the pushing exercise motion. In this application, the reference to "pushing" exercise motion is generally referred to as the "positive" exercise motion, while the pulling motion is referred to as the "opposite" or reverse motion, though as explained above, this is primarily a matter of preference. If the pulling motion were referred to as the "positive" motion then the pushing motion would be considered the "opposite" or reverse with respect thereto.

The second frame section 15 resides opposite the first frame section 14, on the other side of the midplane 16. Generally, the second frame section 15 includes a base 21 and a workbox 39 which are identical to those of the first frame section. That is, the base 21 includes a forward support 23, a center support 25 and front and rear angled uprights 27 and 29, respectively. Connector plate 31 connects the second frame section 15 to the forward connector 19, and the second frame section 15 includes forward support plate 33 and rearward support plate 35. Also, a brace 37 extends upwardly from the back angled support 29 (as best shown in FIG. 1).

The workbox 39 generally includes a crossbar support 41, and internal and external uprights 43*a* and 43*b*, respectively, with an axle 45 extending therebetween. The axle 45 is operatively connected to the uprights 43*a* and 43*b* by bearings 47*a* and 47*b*, to permit relative rotation therebetween.

The lever 49 differs from the lever 48 in that lever 49 is adapted for a pulling exercise motion, rather than a pushing exercise motion. Nevertheless, lever 49 also includes upper and lower angle members 49*a* and 49*b*, respectively, along with an elongated member 49*c*. The elongated member 49*c* is somewhat bent at a midportion thereof to better accommodate the location of the handle 57 with respect to the exercise position 17. The lever 49 also includes a hub 51 for supporting one or more weighted plates 53 to provide a selectable weight resistance. Again, as with respect to the first frame section 14 and lever 48, lever 49 may be constructed so as to provide a different manner of applying weight resistance to pivotal movement, such as a pulling and weight stack. The handle 57 includes a first portion 57*a* which extends toward the midplane 16 and a second portion 57*b* which extends forward with respect to the exerciser located in the exercise position.

As with first lever 48, second lever 49 moves through a path of motion which is closer to the midplane 16 when in a forwardmost position and farthest from the midplane 16 when in a rearwardmost position. The difference is that the at rest position for lever 49 is in the forwardmost position, closest to the midplane 16, while the at rest position for the lever 48 is in the rearwardmost position. The Figures show levers 48 and 49 in their at rest position. Preferably, the first frame section 14 includes a cushion 58 (FIG. 4) for supporting the lever 48 in the at rest position, to prevent metal-to-metal contact of various members of the fame 10. Similarly, second frame section 15 includes a cushion 59 for supporting lever 49 in at rest position.

As with first frame section 14, preferably with the lever 49 of second frame section 15, the base 21 and the lever 49 are oriented along a vertical plane which converges toward the midplane 16, with respect to the forward facing direction of an exerciser located at the exercise position 17. Also, the axle 45 is aligned along an angle which is perpendicular to the plane of convergence, and also obtuse with respect to the vertical midplane 16.

As shown in the drawings, axle 44 resides in a horizontal plane which the handle 56 does not intersect during the exercise motion. Similarly, axle 45 resides in a horizontal plane which the handle 57 does not intersect during the exercise motion. In the illustrated embodiment, the handles 56 and 57 remain above the horizontal planes of their respective axles 44 and 45. The horizontal plane of axle 44 and axle 45 may be the same horizontal level.

In use, an exerciser located at the exercise position 17, and preferably in a standing mode, grasps the handles 56 and 57 and begins performing a push/pull exercise motion by pushing handle 56 forwardly and pulling handle 57 rearwardly. If performed simultaneously, which is readily accomplished because the levers 48 and 49 are independently pivotal, the exerciser experiences a twisting effect of the torso, thereby to help development of the muscles in that portion of the body. Also, if the forward pushing motion is considered the "positive" exercise motion, the pulling motion on handle 57 is the "opposite" or reverse exercise motion with respect thereto. In other words, the exerciser is able to work both arms, and the corresponding muscles groups on opposites sides of the body, with positive and reverse weight resistance via generally the same muscular movement. By providing a mirror image exercise machine (not shown) of the device shown in the Figures, the exerciser is able to perform the opposite exercise motion, thereby to achieve both positive and reverse resistance to this particular exercise motion for this particular set of muscles. In addition to achieving the positive and reverse exercise of this muscle group in a relatively safe and consistent manner through prescribed paths of motion defined by the exercise machine 10, the exerciser achieves an additional degree of muscle toning due to the fact that the exercises may be performed from the standing position. Moreover, the twisting torso effect achieved via simultaneous pushing and pulling, or pulling and pushing, provides additional muscular benefits.

While a preferred embodiment of the invention has been described, those skilled in the art will readily appreciate the various modifications to which this invention is susceptible. For instance, the particular planes of movement for the lever and/or handles may be varied to perhaps better accommodate the particular needs of various sizes and shapes of the human body. Such variations would not depart from the principle of this invention, which includes the ability to simultaneously perform "positive" and "reverse" exercise for a desired muscle group.

Therefore, applicant desires to be limited only by the scope of the following claims and equivalents thereof.

I claim:

1. An exercise machine comprising:

a frame including two connected frame sections located on opposite sides of a midplane, and defining an exercise position therebetween for locating an exerciser in a forward facing direction along the midplane;

the first frame section being arranged rearward of the second frame section relative to the exercise position;

the first frame section including a first axle and a first lever which is pivotally movable in a forward direction about said first axle against a first selectable weight resistance, via application of a pushing exercise motion to the first lever;

the second frame section including a second axle and a second lever which is pivotally movable in a rearward direction about said second axle against a second selectable weight resistance, via application of a pulling motion, the first and second levers being independently pivotal;

wherein the first axle is located rearward of the second axle relative to said exercise position.

2. The exercise machine of claim 1 wherein said first axle is arranged rearward of said second axle.

3. The exercise machine of claim 1 wherein said selectable weight resistance comprises one or more weighted plates stackable on a hub extending outwardly from the first lever or the second lever.

4. The exercise machine of claim 1 wherein said selectable weight resistance comprises a weighted stack connected to the first lever or the second lever.

5. The exercise machine of claim 4 wherein said weighted stack is connect to the first lever or the second lever via a chain and pulley.

6. A push/pull exercise machine comprising:

a frame including two connected frame sections located on opposite sides of a midplane, and defining an exercise position therebetween;

the first frame section being arranged rearward of the second frame section relative to the exercise position;

the first frame section including a first lever which is pivotally movable in a forward direction against a selectable weight resistance, in a pushing exercising motion;

the second frame section including a second lever which is pivotally movable in a rearward direction against a selectable weight resistance in a pulling motion, the first lever and the second lever being independently pivotal; and wherein the first and second levers move in paths which converge with respect to the midplane;

wherein the first lever is located rearward of the second lever relative to the exercise position.

7. A push/pull exercise machine comprising:

a frame supported on a floor and including two connected frame sections located on opposite sides of a midplane, and defining an exercise position therebetween;

the first frame section being arranged rearward of the second frame section relative to the exercise position;

the first frame section including a first axle and a first lever with a first handle and adapted for pivotal movement about said first axle in a forward direction against a selectable weight resistance, in a pushing exercise motion;

the second frame section including a second axle and a second lever with a second handle and adapted for pivotal movement about said second axle in a rearward direction against a selectable weight resistance in a pulling motion, the first and second levers being independently pivotal;

wherein the first and second levers move in paths which converge with respect to the midplane; and wherein said first axle is arranged rearward of said second axle relative to the exercise position.

8. The exercise machine of claim 7 wherein the handles are located so that the pushing and pulling motions may be performed in a standing mode.

9. A push/pull exercise machine comprising:

a frame supported on a floor and including two connected frame sections located on opposite sides of a midplane, and defining an exercise position therebetween;

a first of the frame sections including a first axle and a first lever with a first handle adapted for pivotal movement about said first axle in a forward direction against a selectable weight resistance, in a pushing exercise motion from an initial rest position to a forward position;

a second of the frame sections including a second axle and a second lever with a second handle adapted for pivotal movement about said second axle in a rearward direction against a selectable weight resistance in a pulling motion from an initial rest position to a rearward position, the first and second levers being independently pivotal; and wherein the first handle is located rearward of the second handle relative to the exercise position when the levers reside in the rest positions, and the first and second levers move in paths which converge with respect to the midplane.

10. The exercise machine of claim 9 wherein said first axle is arranged rearward of said second axle relative to the exercise position.

11. The exercise machine of claim 9 wherein the handles are located so that the pushing and pulling motions may be performed in a standing mode.

12. An exercise machine comprising:

a frame including connected first and second frame sections located on opposite sides of a midplane, and defining an exercise position therebetween;

a first lever pivotally connected to the first frame section about a first axle and including a first weight holder for holding a first selected weight resistance and a first handle for pivoting the first lever about a first pivot axis in a first direction via a first exercise motion against the force of the first selected weight resistance;

a second lever pivotally connected to the second frame section about a second axle and including a second weight holder for holding a second selected weight resistance and a second handle for pivoting the second lever about a second pivot axis in a second direction, opposite the first direction, via a second exercise motion against the force of the second selected weight resistance;

wherein the first and second levers are independently pivotal so that by grasping the first and second handles, an exerciser may simultaneously perform the first exercise motion and the second exercise motion about the first pivot axis and the second pivot axis; and wherein said first axle is arranged rearward of said second axle relative to the exercise position.

13. A method of doing push/pull exercises comprising the steps of:

providing a push/pull exercise machine, said machine comprising:

a frame having a midplane dividing said frame into a first frame section on a firstside of said midplane and a second frame section on a second side of said midplane, a front portion, and a rear portion, wherein said first frame section is connected at said front portion to said second frame section, wherein said first and second connected frame sections define an exercise position therebetween, said position being open at said rear portion, wherein said first frame section is arranged rearward of the second frame section relative to the exercise position;

a first lever on said first frame section, said first lever pivotally movable about a first axle toward said front portion; and a second lever on said second frame section, said second lever pivotally movable about a second axle toward said rear portion independent of said first lever;

wherein said first axle is arranged rearward of the second axle relative to the exercise position;

standing in said exercise position facing said front portion;

pushing and pulling said first and said second levers respectively.

14. The method of claim 13 wherein the pushing and pulling of said first and second levers respectively is done simultaneously.

15. The method of claim 13 wherein said first frame section is to the right of said second frame section relative to the front portion of the frame.

16. The method of claim 13 wherein said first frame section is to the left of said second frame section relative to the front portion of the frame.

17. The method of claim 13 further comprising the step of selecting a weight resistance and attaching said weight resistance to said first or second lever.

18. The method of claim 17 wherein said step of selecting a weight resistance comprises:

providing a hub extending outwardly from said first or second lever; and stacking weighted plates on said hub.

19. The method of claim 17 wherein said step of selecting a weight resistance comprises connecting said first or second lever to a weighted stack.

* * * * *